US007340857B1

(12) United States Patent
Bentley

(10) Patent No.: US 7,340,857 B1
(45) Date of Patent: Mar. 11, 2008

(54) RECOIL SYSTEM FOR THE FOREND OF A FIREARM

(75) Inventor: James K. Bentley, Paso Robles, CA (US)

(73) Assignee: Blackhawk Industries Product Group Unlimited LLC, Norfolk, VA (US)

( * ) Notice: Subject to any disclaimer, the term of this patent is extended or adjusted under 35 U.S.C. 154(b) by 25 days.

(21) Appl. No.: 11/132,872

(22) Filed: May 19, 2005

(51) Int. Cl.
*F41A 21/26* (2006.01)

(52) U.S. Cl. ..... 42/1.06; 89/14.3

(58) Field of Classification Search ..... 42/90, 42/1.06; 89/14.3, 198
See application file for complete search history.

(56) References Cited

U.S. PATENT DOCUMENTS 2,104,129 A * 1/1938 Kress ..... 42/71.01
2,826,848 A * 3/1958 Davies ..... 42/71.01
4,502,238 A * 3/1985 Farrar et al. ..... 42/72
4,514,921 A * 5/1985 Burkleca ..... 42/1.06
5,048,215 A * 9/1991 Davis ..... 42/72
5,417,002 A * 5/1995 Guerra ..... 42/72
5,524,374 A * 6/1996 Gernstein ..... 42/1.06
5,722,195 A * 3/1998 Bentley et al. ..... 42/74
6,055,760 A * 5/2000 Cuson et al. ..... 42/74
6,101,918 A * 8/2000 Akins ..... 89/129.01

* cited by examiner

*Primary Examiner*—Bret Hayes
(74) *Attorney, Agent, or Firm*—Bowman Green Hampton & Kelly, PLLC

(57) ABSTRACT

A recoil reduction system for the front end of a firearm, such as a shotgun or a rifle. In a first embodiment, the recoil reduction structure is mounted in a handgrip member secured to the bottom surface of the forend member. Various types of springs and cylindrical elastomer members can be utilized in various handgrip members. In a second embodiment the recoil reduction system is mounted in the forend member. In a third embodiment, the recoil reduction structure is utilized with a rifle having a long gun stock. The long gun stock has a butt portion, a middle portion and a front portion. The front portion is located forwardly of the receiver. A primary recess is formed in the bottom wall of the front portion and the recoil reduction structure is mounted therein. A cover member positioned over the primary recess hides the recoil reduction structure from view. A handle member may be secured to the bottom surface of the cover member and it may be retractable or rigidly positioned upright.

14 Claims, 10 Drawing Sheets

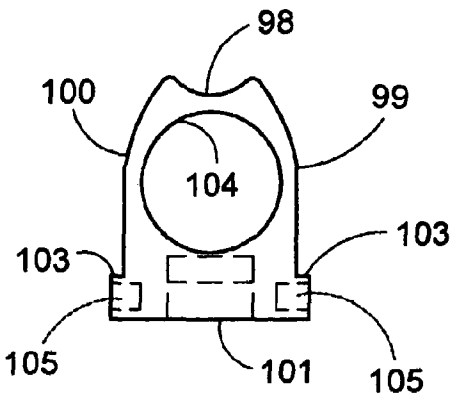
FIG. 15
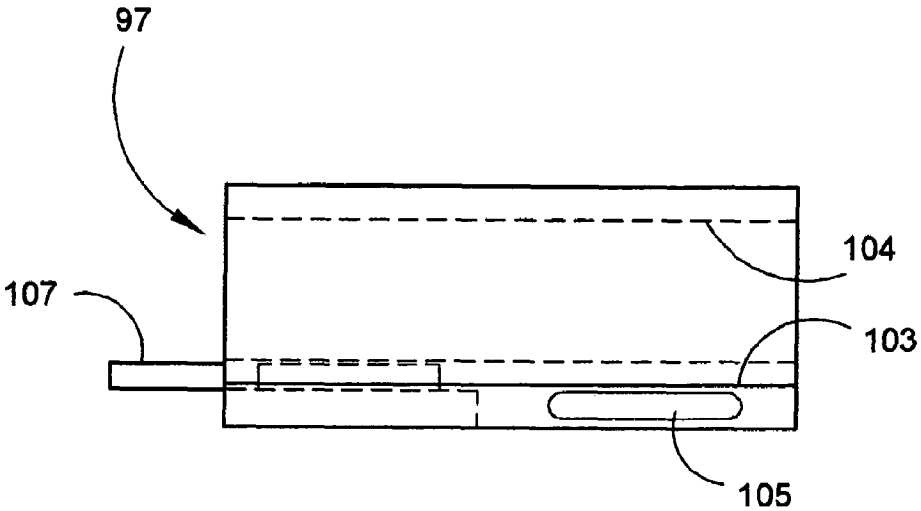
FIG. 14
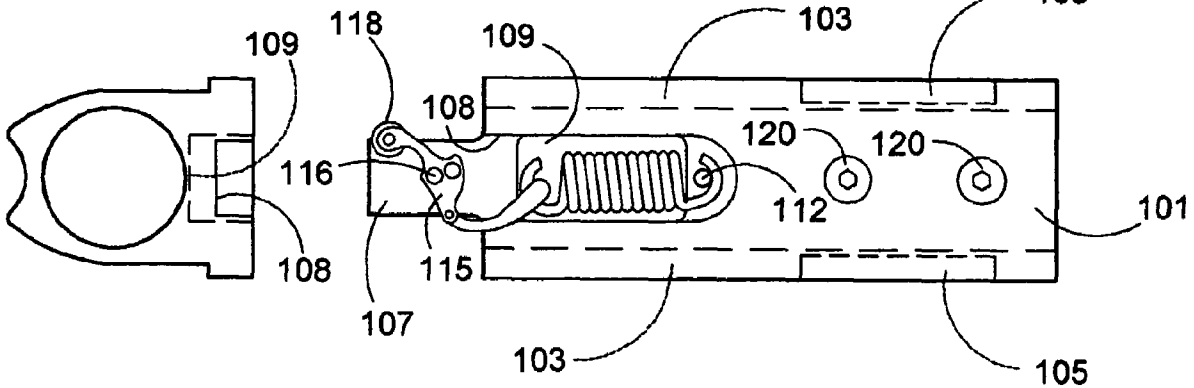
FIG. 17
FIG. 16

RECOIL SYSTEM FOR THE FOREND OF A FIREARM

BACKGROUND OF THE INVENTION

The invention relates to firearms and more specifically to a recoil system for rifles and shotguns.

One age-old problem that has existed with firearms is the fact that many of them have a severe recoil that affects the person firing the weapon. In firearms such as shotguns and rifles, the rear end of the butt stock is positioned against the shooter's shoulder and recoil often causes the shooter to raise the front of the firearm each time the weapon is fired. Also recoil varies depending upon the amount of explosive being fired and the recoil can result in pain and/or bruising to the shoulder area of the person firing the weapon. One example of the recoil being detrimental to a shooter's accuracy is where the firearm is a shotgun being used for skeet shooting by a male or a female.

In the past, the best prior art recoil systems for the butt stock of a firearm have been very expensive and the inexpensive systems did not function properly. Two examples of expensive systems are a hydro-coil fluid dampening system and a pneumatic air chamber system. The present inexpensive recoil systems utilize compression coil springs to absorb the recoil forces. If the compression coil spring is a little too strong, you get more recoil than with a regular firearm. If the compression coil spring is not strong enough it is worse, in that it gives the gun some travel and it is the same as holding the butt stock too loosely.

One improvement in recoil systems for a firearm is illustrated in the Bentley et al U.S. Pat. No. 5,722,195. It has a pistol grip recoil assembly having a recoil base member and a pistol grip. The recoil base member is detachably secured to the rear end of the receiver of the firearm and it has an inverted T-shaped rail formed on its bottom wall. This inverted T-shaped rail is captured within and slides in an inverted T-shaped groove in the top end of the pistol grip. A recess formed in the front wall of the pistol grip adjacent its top end allows the trigger guard of the firearm to travel rearwardly with respect to the pistol grip when the firearm is fired. Various embodiments utilize springs to return the recoil base member forwardly to its static position after dissipating the recoil of the firearm resulting from its being fired.

Another recent improved recoil system for a firearm is illustrated in the Bentley et al U.S. Pat. No. 5,752,339. This patent discloses a recoil system for the butt stock of a firearm having a recoil suppressor assembly whose front end is mounted in the cavity in the rear end of the gun stock. The piston ram of the recoil suppressor assembly in its static position extends rearwardly into a bore hole cavity of a elongated recoil housing. When the firearm is shot, the elongated body portion of the recoil suppressor assembly and its transversely extending mounting flange portion instantaneously travel rearwardly into the bore cavity with the bore hole of the body housing reciprocally traveling over the piston ram. A coil spring whose front end is secured to the front end of the body portion whose rear end is secured to a cam assembly returns the elongated body portion to a static position once the recoil of the firearm has been suppressed.

It is an object of the invention to provide a novel recoil system for a firearm that minimizes the amount of recoil force experienced by the person firing the weapon.

It is also an object of the invention to provide a novel recoil system for a firearm that minimizes pain to the shoulder of the person firing the weapon due to recoil forces.

It is another object of the invention to provide a novel recoil system for a firearm that requires limited modification to the forend of a shotgun.

It is a further object of the invention to provide a novel recoil system for a firearm that utilizes a block of elastomer material.

It is also an object of the invention to provide a novel recoil system for the butt stock of a firearm that is easily mounted on the magazine tube of a shotgun.

It is a further object of the invention to provide a novel recoil system for shotguns and rifles that is economical to manufacture and market.

It is an additional object of the invention to provide a novel double recoil system for a handgrip attached to a forend.

It is also an object of the invention to provide a novel recoil reduction system that can be installed into a long gun stock such as used with rifles.

It is another object of the invention to provide a novel recoil reduction system that allows a lottery powered light to be supported by a handgrip member positioned forwardly of the receiver of a shotgun.

SUMMARY OF THE INVENTION

The novel recoil reduction system has been designed to be used with firearms such as shotguns and rifles. In each instance the recoil reduction structure is mounted forwardly of the receiver of the firearm. In one embodiment the recoil reduction structure is incorporated on the bottom wall of a forend and having an upright handgrip secured to the bottom of the forend. The recoil reduction structure incorporates an inverted T-shaped rail extending downwardly from the forend that travels reciprocally forward and back in a track formed in the top end of the handgrip member. The handgrip member is gripped by the shooter's forward hand and when the gun is fired, the recoil action takes place forwardly of the receiver. The shooter can hold the firearm with the butt of the firearm spaced from the shooter's shoulder with out receiving a kick that stuns or bruises the shooter's shoulder.

The novel recoil reduction system can also be incorporated into the structure of a forend that does not have a handgrip member. The novel recoil reduction system can also be installed into the long gun stock of a rifle at a location forward of the receiver. Again in this instance, the shooter's front hand would be gripping the cover member located beneath a cutout cavity in the bottom surface of the long gun stock.

Another benefit of having the recoil reduction system mounted in front of the receiver is that in the version with the handgrip extending downwardly, the handgrip has little or no recoil to it when the firearm is fired. Therefore when incorporating a light mounting portion on the front of the substantially stationary hand gripping member, the light projected forwardly maintains a stable beam of light.

DESCRIPTION OF THE DRAWINGS

FIG. 14 is a side elevation view of the support unit for the recoil reduction structure received in the forend illustrated in FIGS. 11-13;

FIG. 15 is a front elevation view of the support unit illustrated in FIG. 14;

FIG. 16 is a rear elevation view of the support unit illustrated in FIG. 14;

FIG. 17 is a bottom plan view of the support unit illustrated in FIG. 14;

DESCRIPTION OF THE PREFERRED EMBODIMENT

Figure 1:
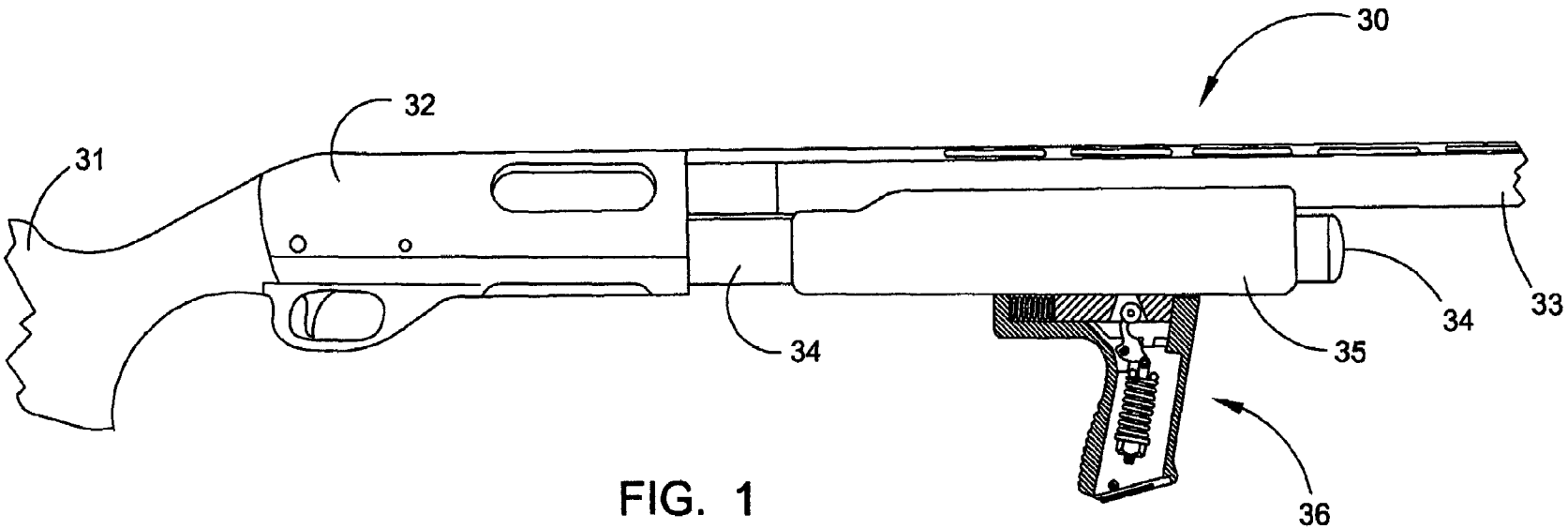
FIG. 1 is a side elevation view of a shotgun illustrating the recoil reduction system mounted in a handgrip member secured to the bottom of the forend.
Figure 5:
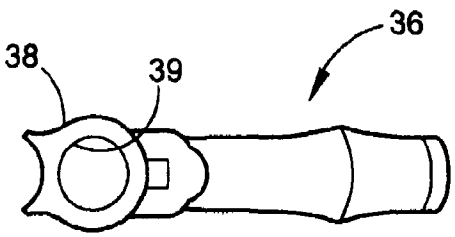
FIG. 5 is a front elevation view of FIG. 2.
Figure 3:
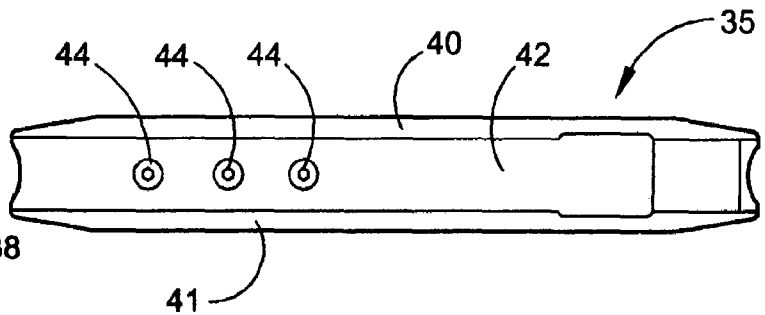
FIG. 3 is a top plan view of the forend illustrated in FIG. 2.

The novel recoil reduction system for a firearm will now be described by referring to FIGS. 1-9 and 18-19. A shotgun 30 is illustrated in FIG. 1 having butt stock 31, a receiver 32, a gun barrel 33, a magazine 34, a forend 35 and a handgrip member 36. The recoil reduction system is mounted within handgrip member 36.

Figure 4:
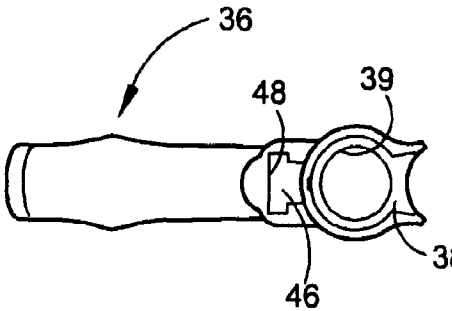
FIG. 4 is a rear elevation view of FIG. 2.
Figure 2:
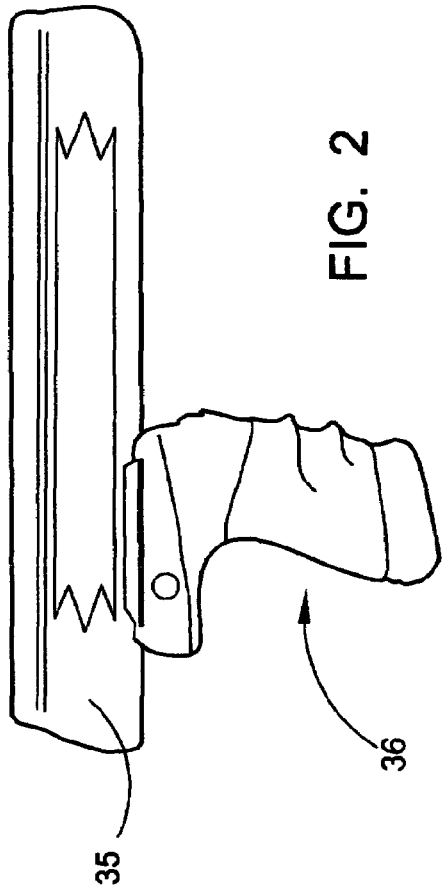
FIG. 2 is an enlarged side elevation view of a forend having the recoil reduction system mounted in the handgrip member.

FIGS. 2-5 and 18-19 illustrate views of the forend 35 from various sides and angles. FIG. 4 is a rear elevation view and it shows that forend 35 has a generally U-shaped transverse profile with a ring 38 formed at its front end. Ring 38 has a bore hole 39 that would telescope over magazine 34. The remainder of forend 35 has a left side wall 40, a right side wall 41 and a bottom wall 42. A plurality of screws 44 secure an inverted T-shaped rail 46 to the bottom surface of forend 35. Handgrip member 36 has a longitudinally extending inverted T-shaped track 48 along which rail 46 reciprocally travels. Track 48 has a chamber 49 formed in its rear end that receives an elastomer block 51 having a cylindrical shape. Track 48 and chamber 49 are formed in track housing 52 that extends rearwardly from the top end of handgrip 36. A cavity 53 is formed in the bottom surface of rail 46. A primary chamber 54 extends upwardly through almost all of the height of handgrip member 36. A lever 56 is pivotally mounted in primary chamber 54 by a pivot pin 57. A cam roller 58 is mounted on the top end of lever 56 by a pin 59. A retainer ring 61 is mounted on the bottom end of lever 56 by a pin 62. A coil spring 63 has its top hook member 64 captured in retainer 61. Coil spring 63 has a bottom hook member 65 captured by the rigid pin 66.

Forend 35 is rigidly secured to the magazine 34 or other structure that is rigidly secured to receiver 32. When the shotgun is fired, a forend 35 recoils rearwardly causing rail 46 to also travel in the same direction. The elastomer block 51 is compressed to reduce some of the recoil. Cam roller 58 is pivoted rearwardly about pivot pin 57 causing coil spring 63 to be stretched and then returned to its static position and this also provides recoil reduction.

Figure 7:
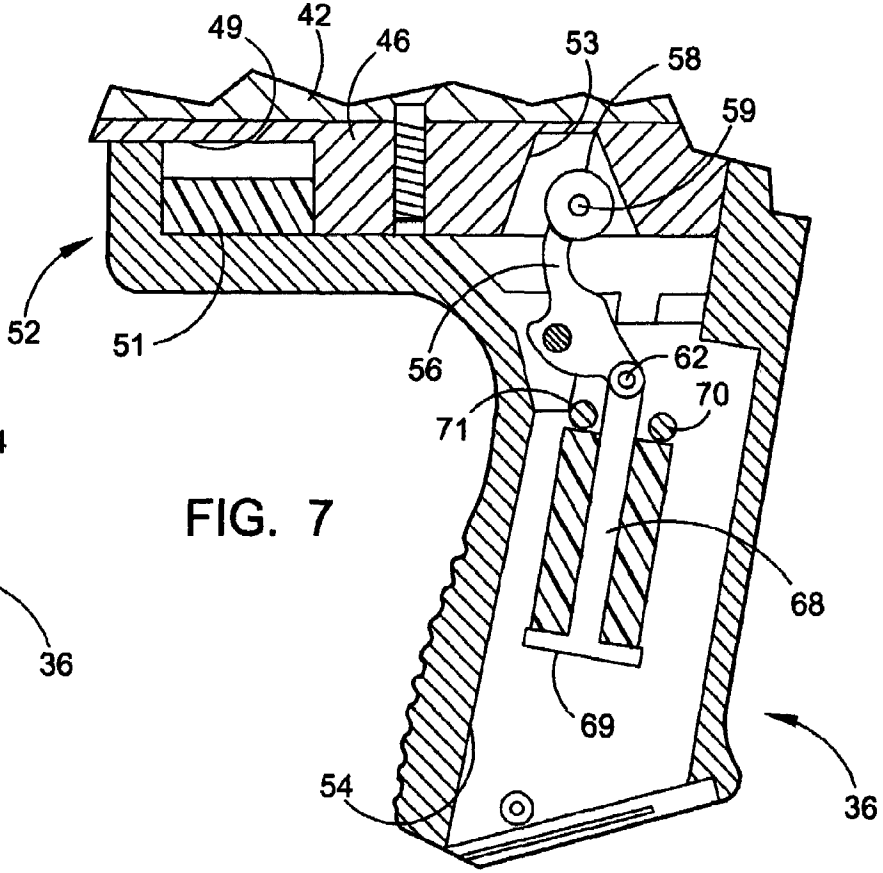
FIG. 7 is a vertical cross section view illustrating a second embodiment of the recoil reduction system mounted in the handgrip member.
Figure 6:
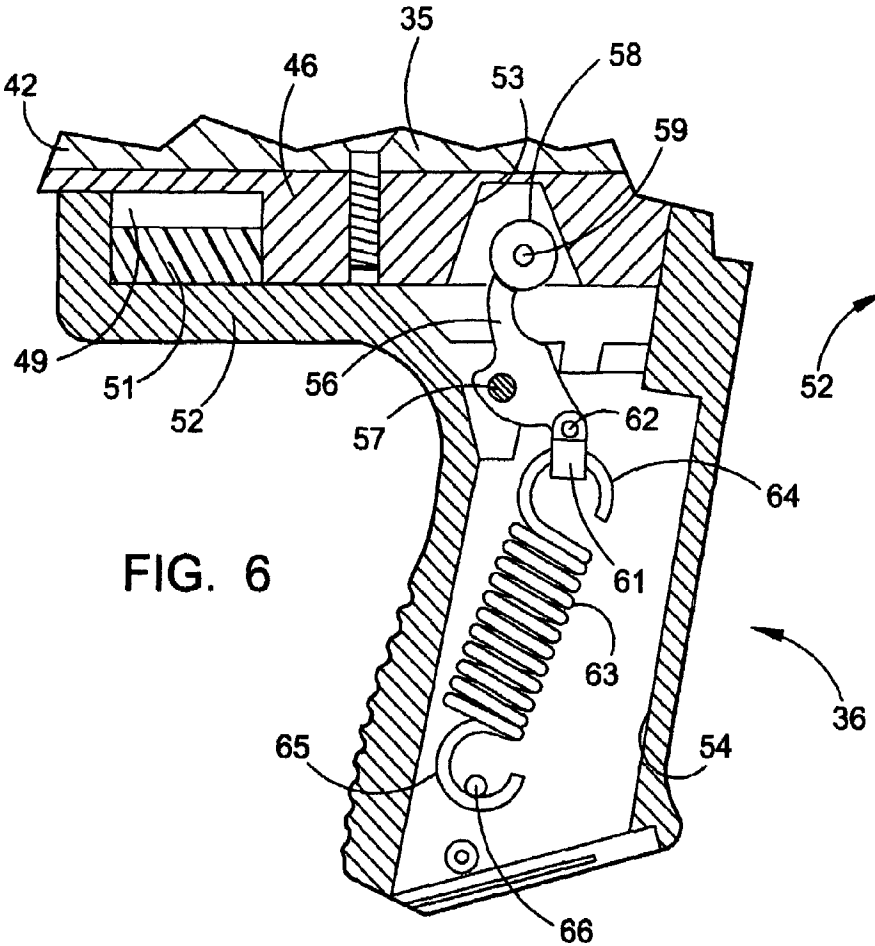
FIG. 6 is a vertical cross section view illustrating a first embodiment of the recoil reduction system mounted in the handgrip member.

The first variation of the recoil reducing structure in the handgrip member 36 is illustrated in FIG. 7. A rod 68 has its bottom end connected to plate 69 and its top end is pivoted on pin 62. An elastomer tube 70 is telescoped over rod 68 and its top end bears against pins 70 and 71. Rearward travel of rail 46 will pivot lever 56 rearwardly causing elastomer tube 70 to be compressed and reduce recoil.

Figure 8:
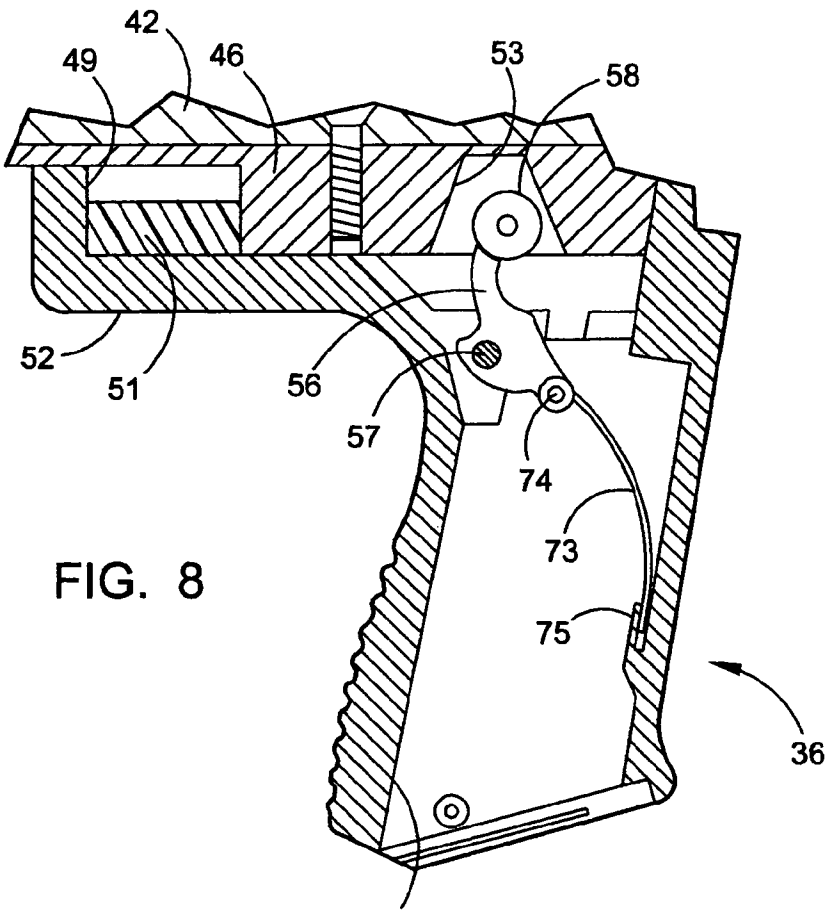
FIG. 8 is a vertical cross section view illustrating a third embodiment of the recoil reduction system mounted in the handgrip member.
Figure 10:
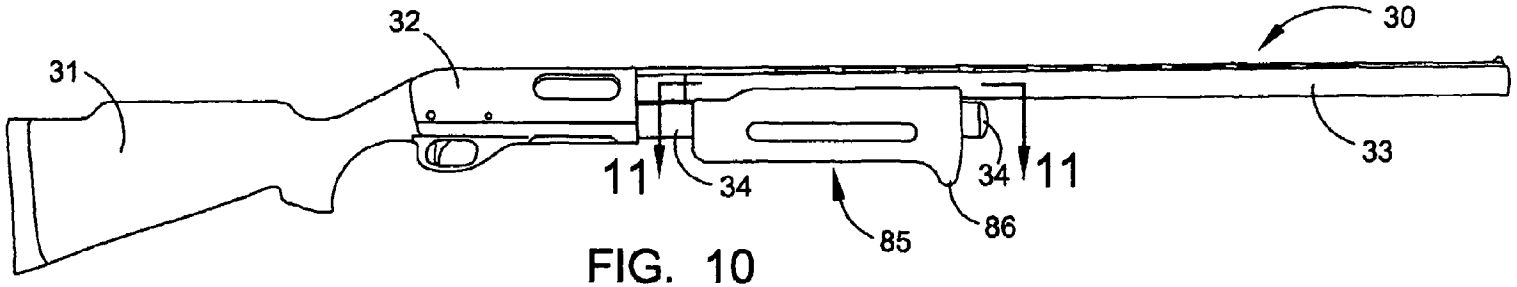
FIG. 10 is a side elevation view of a shotgun illustrating the recoil reduction system mounted within the interior of the forend member.

A second alternative recoil reducing structure is illustrated in FIG. 8. It has a leaf spring 73 having a stressed curvature in its static state. Its top end is captured by attachment structure 74 on the bottom end of lever 56 and its bottom end is captured in slot 75 in the inner wall of handgrip member 36. Rearward travel of rail 46 will compress elastomer block 51 causing recoil reduction. Likewise spring 73 will be stretched upwardly when lever 56 is rotated rearwardly. This also reduces the recoil force.

Figure 9:
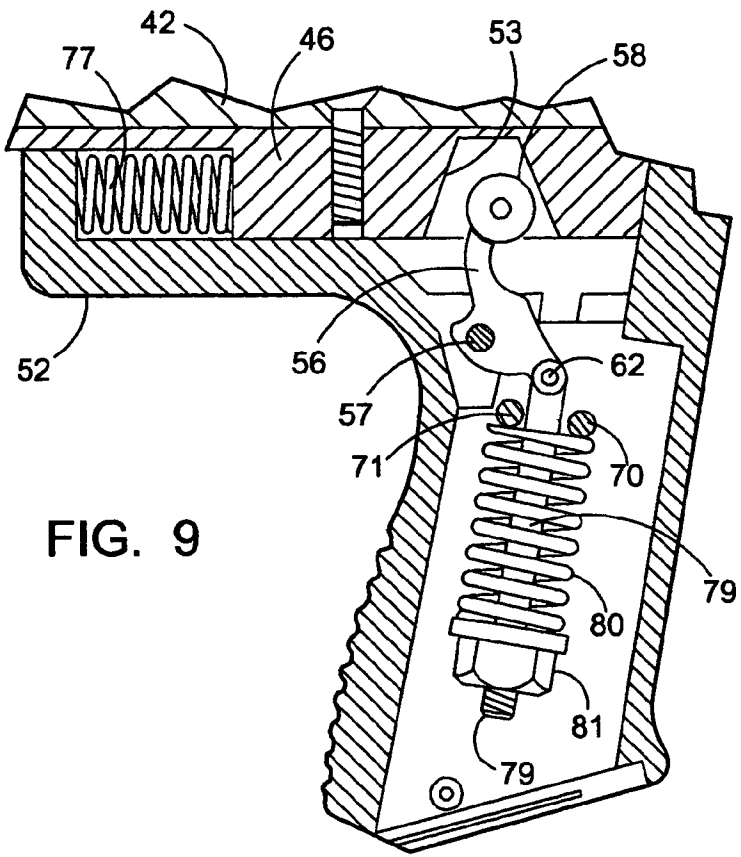
FIG. 9 is a vertical cross section view illustrating a fourth embodiment of the recoil reduction system mounted in the handgrip member.

A third alternative recoil structure is illustrated in FIG. 9. It has a coil spring 77 in rail chamber 49. A screw 79 has its top end captured by pin 62. A coil spring 80 surrounds screw 79 and has a nut 81 on its bottom end. Pins 70 and 71 press against the top end of spring 80. When rail 46 travels rearwardly, coil spring 77 reduces the recoil force. Also as lever 56 has its top end pivoted rearwardly, spring 80 would be compressed to also reduce recoil force.

In Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and the number and configuration of various vehicle components described above may be altered, all without departing from the spirit or scope of the invention as defined in the appended Claims.

Figure 11:
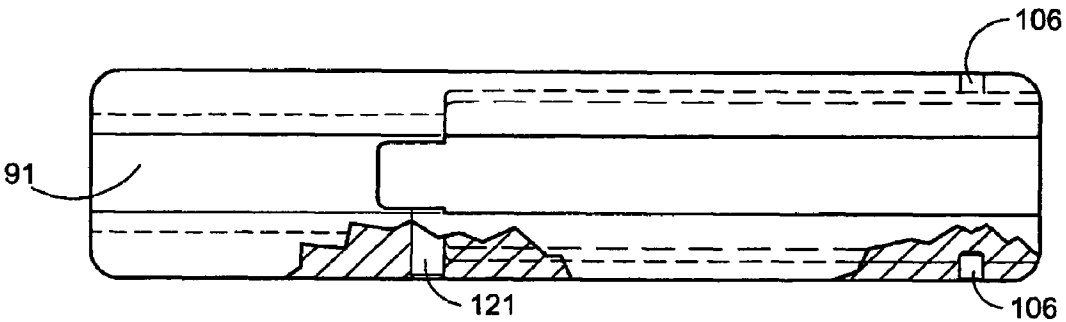
FIG. 11 is a top plan view of the forend member illustrated in FIG. 10.
Figure 12:
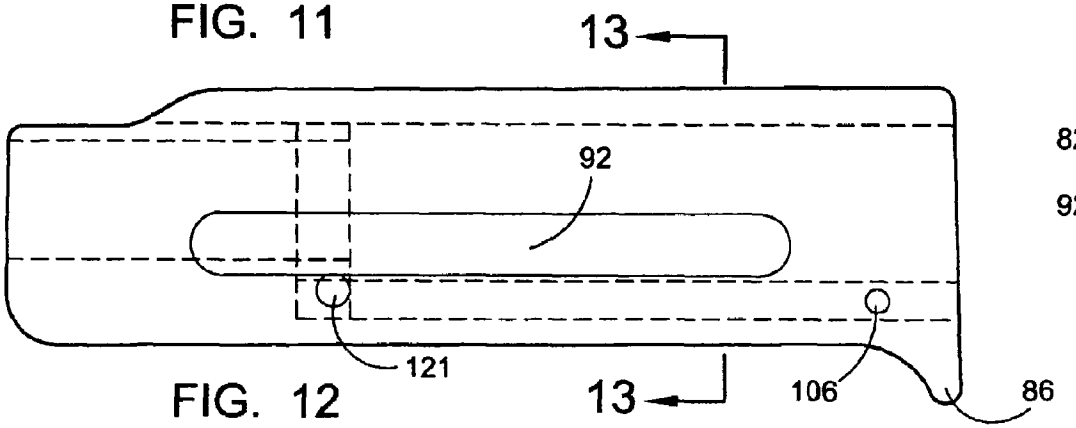
FIG. 12 is a right side elevation view of the forend member illustrated in FIG. 10.
Figure 13:
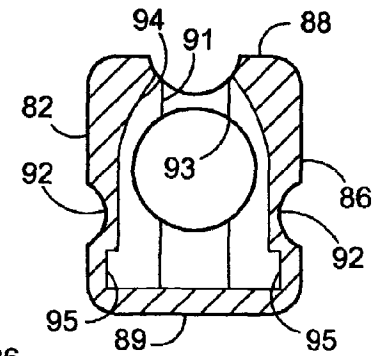
FIG. 13 is a cross sectional view taken along lines 13-13 of FIG. 12.
Figure 19:
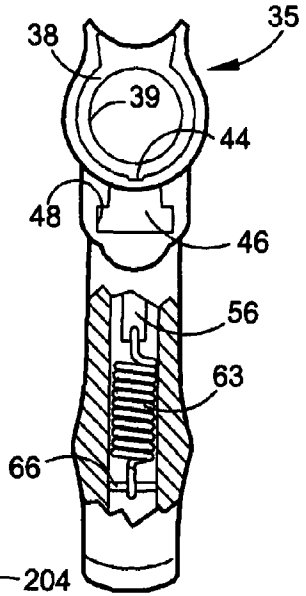
FIG. 19 is a front elevation view of FIG. 18 with portions shown in cross section.
Figure 18:
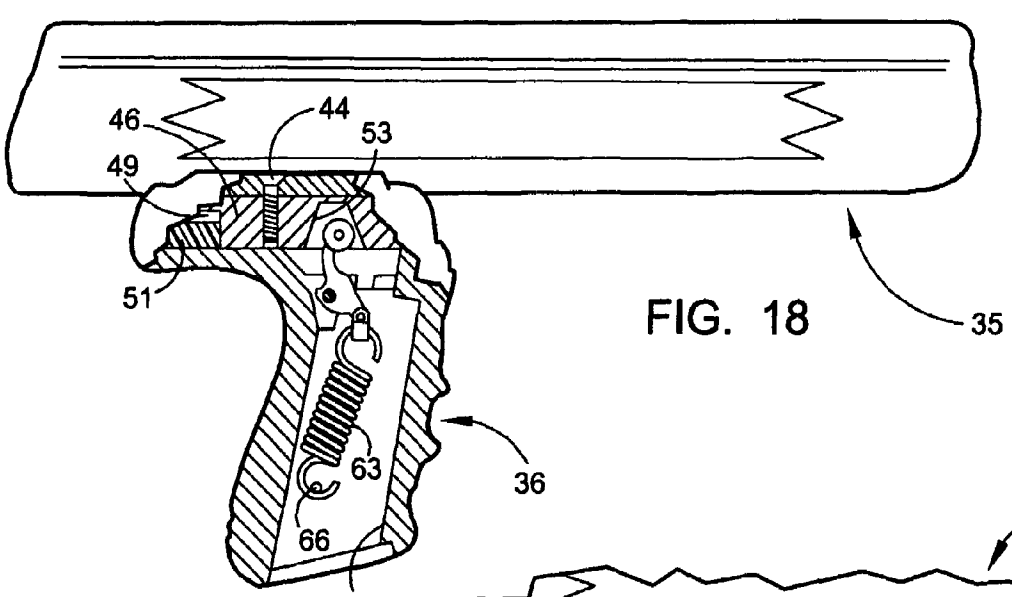
FIG. 18 is an enlarged view of FIG. 2 with portions of the handgrip member illustrated in cross section.

In FIGS. 10-17, the recoil reduction system is mounted inside forend 85. Forend 85 has a handrest stop 86 extending downwardly from its forward end to prevent the shooter's hand from slipping off the forend. FIGS. 11-13 illustrate different views of forend 85. Forend 85 is generally U-shaped throughout most of its length. It has a left side wall 86, a right side wall 87, a top wall 88, and a bottom wall 89. A portion of forend 85 has a connecting wall member 91 at its top end and a bore hole 92 is formed for telescopically receiving the magazine 34. Finger grooves 92 are formed along the outside surface of the respective left and right side walls. Forend 85 has an interior cavity 94 having outwardly extending tracks 95 adjacent its bottom end.

The structure for mounting the recoil reduction system is illustrated in FIGS. 14-17 and is generally identified as support unit 97. Support unit 97 is a solid piece of material that is telescopically received in cavity 94 of forend 85. Support unit 97 has a top wall 98, a left side wall 99, a right side wall 100, a bottom wall 101 and rails 103 extend outwardly from the respective side walls adjacent bottom wall 101. A bore hole 104 extends the length of support unit 97 so that it telescopes over magazine 34. Grooves 105 extend inwardly into rails 103 and these grooves receive set screws 106 extending inwardly from the side walls of forend 85. Bottom wall 101 is best seen in FIG. 7. It has a tongue 107 extending from its front end. An outer cavity 108 is formed in bottom wall 101 for receiving part of the hardware of the recoil reduction system. A second deeper cavity 109 accommodates the bottom portion of coil spring 110. One end of coil spring 110 is secured to a pin 112 and the other end is secured to a retainer member 113 whose free end is secured to one end of lever 115. Lever 115 is secured to tongue 107 by a pivot pin 116. A cam roller 118 is supported by a pin on the other end of lever 115. Attachment screws 120 secure support unit 97. As support unit 97 travels rearwardly, cam roller 118 engages pin 121 extending into the side wall of forend 85. It engages cam roller 118 causing it to rotate about pivot pin 116 causing spring 110 to be stretched and reduce recoil.

In FIGS. 20-24, the recoil reduction system is mounted in a rifle 123. Rifle 123 has a recoil suppression butt stock assembly 125, a receiver 126, a gun barrel 127 and a long gun stock 128. For the embodiment to be discussed, long gun stock 128 would have a removable front piece 130. It is to be understood that a single long gun stock 28 could also have primary recess 132 integrally formed in a single long gun stock. In the illustrated embodiment, stock cover 134 can only be installed by removing front piece 130. Long gun stock 128 has three identifiable portions, butt stock portion 136, middle portion 137 and front portion 138. Front portion 138 is located forward of receiver 128. Primary recess 132 has a bottom wall 140. Bottom wall 140 has rails 142 extending along its lateral edges and above it are formed an inwardly extending track 144. A recess 146 is formed in bottom wall 140 and lever 147 is mounted on a pivot pin 148 therein. A cam roller 149 is pivotally secured to one end of lever 147. A retainer member 150 is secured to the other end of 147 and it captures one end of spring 152. The other end of spring 152 is captured by a pin 153. The top portion of spring 152 extends into a deeper recess 155. A cover member 160 has a front end 161, a rear end 162, a left side wall 163 and a right side wall 164. Finger grips 167 are formed in both of the side walls 163 and 164. Cover member 160 has a bottom wall 170 having a bore hole 172 therein. Tracks 174 are formed on the inner side wall surfaces and they telescopically receive rails 142. A screw 176 extends upwardly through bore hole 172 and is threaded into the bottom end of a tapered nut 178. Once cover 160 is slid onto rails 142, screw 176 is tightened which causes tapered nut 178 to push upwardly until it contacts cam roller 149 and preloads spring 152. The length of cover member 160 is about 1 inch short of the length of primary recess 132. When the rifle is fired, long gun stock 128 will travel rearwardly while cover member 160 is held stationary by the forward hand of the person holding the rifle. Cam roller 149 will contact tapered nut 178 causing lever 147 to pivot forwardly causing spring 152 to be stretched thereby reducing the recoil force.

Figures 25, 26:
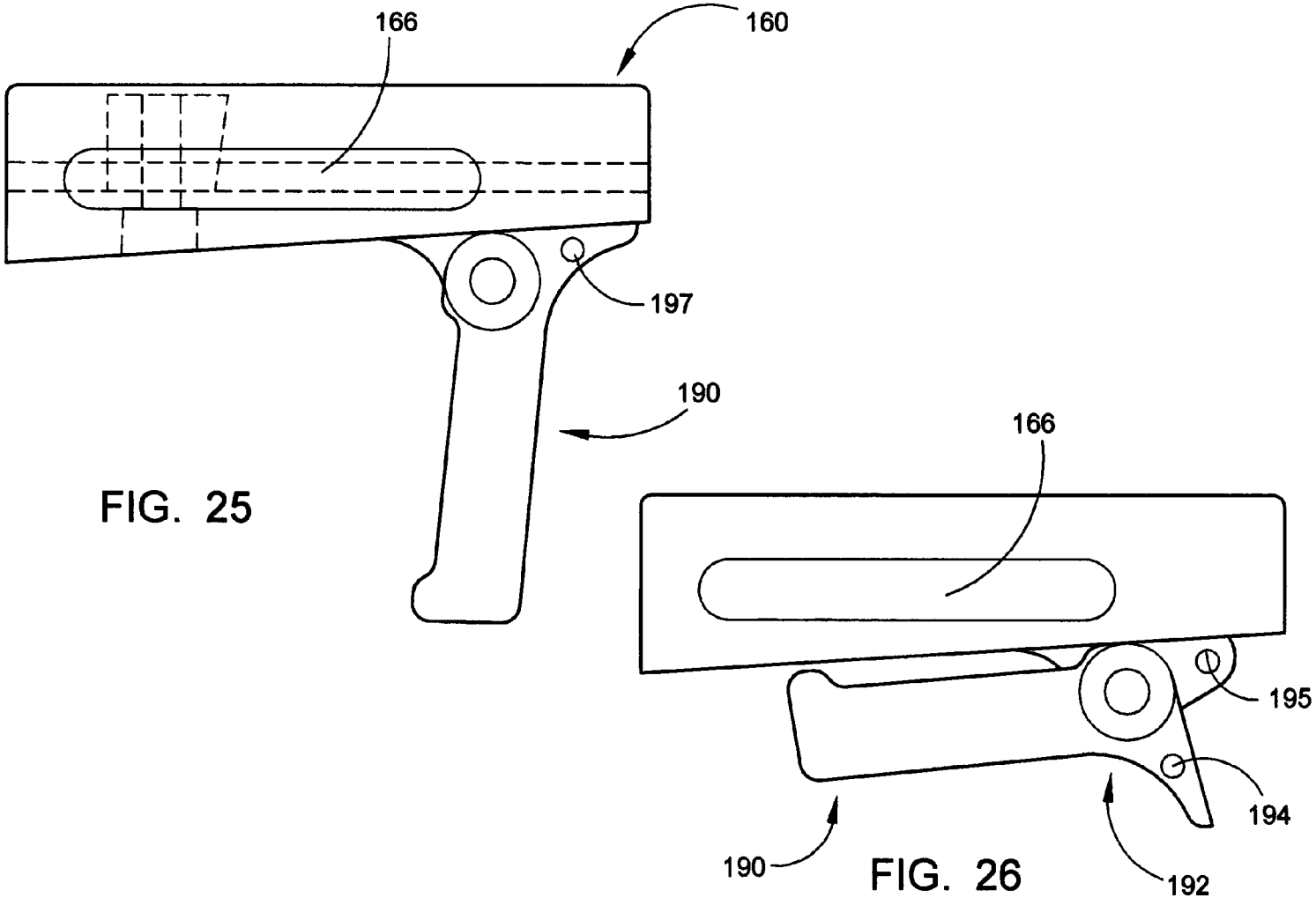
FIG. 25 is a side elevation view of an alternative embodiment of the cover member having a retractable handgrip member secured to its bottom surface.
FIG. 26 is a side elevation view of the alternative cover member showing the handgrip member in its retracted position.

In FIGS. 25 and 26, cover member 160 is illustrated as having a handgrip member 190 with its top end pivotally secured to hinge assembly 192. Handgrip member 190 rotates around pivot pin 194 to its retracted position. When handgrip member 190 is in its down position, bore holes 194 and 195 align to receive a locking pin 197.

Figure 27:
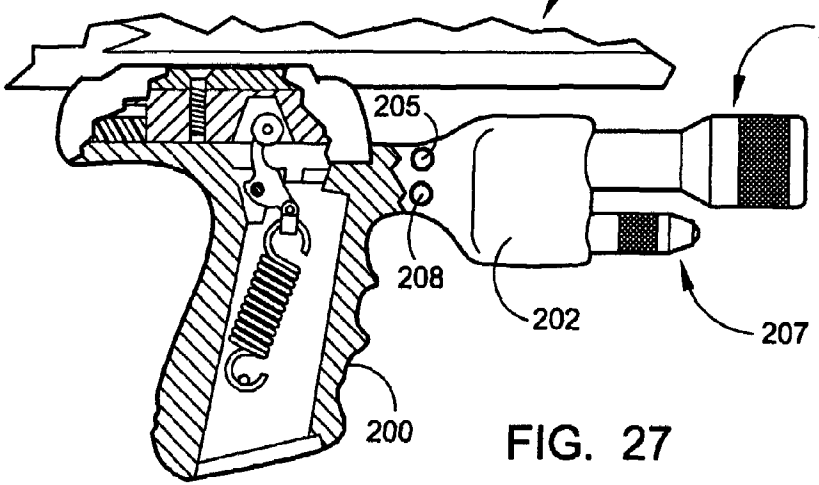
FIG. 27 is a side elevation view illustrating a flashlight and a laser light mounted on the front end of a handgrip member.
Figure 20:
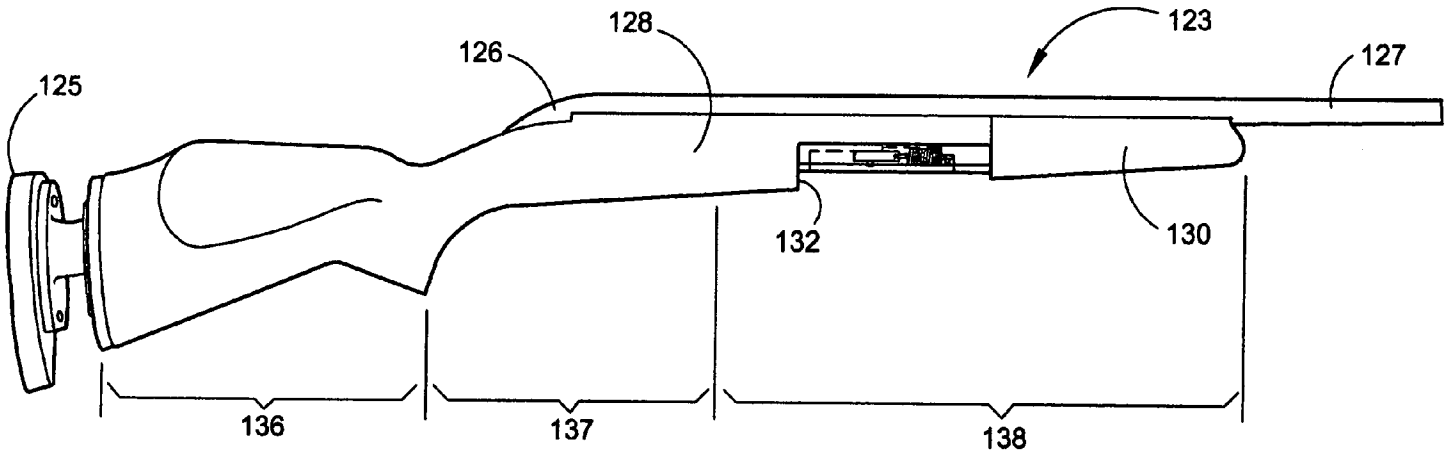
FIG. 20 is a side elevation view of a rifle having the recoil reduction system positioned forwardly of the receiver in the bottom of the long gun stock.
Figure 21:
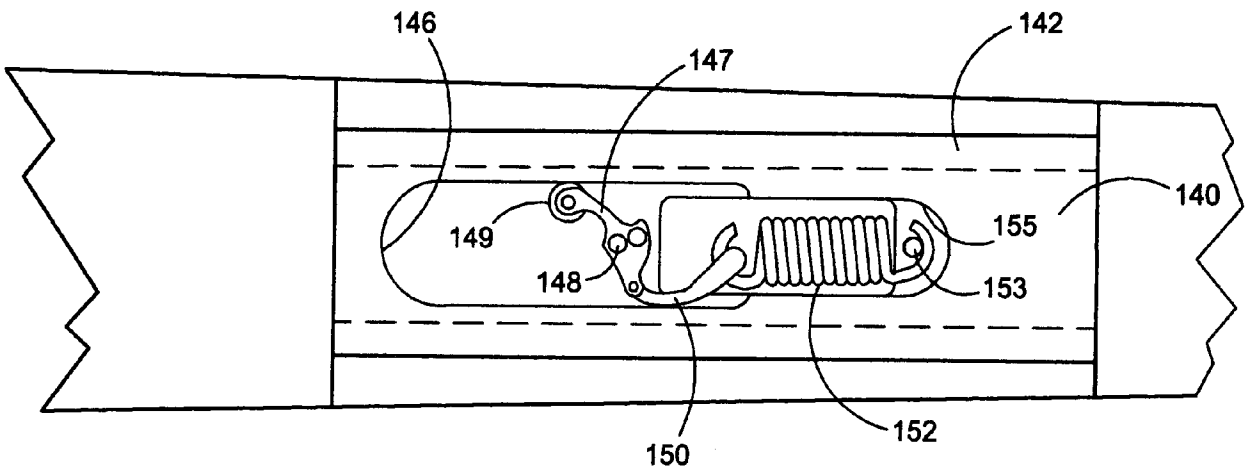
FIG. 21 is a partial bottom plan view of FIG. 20.
Figure 22:
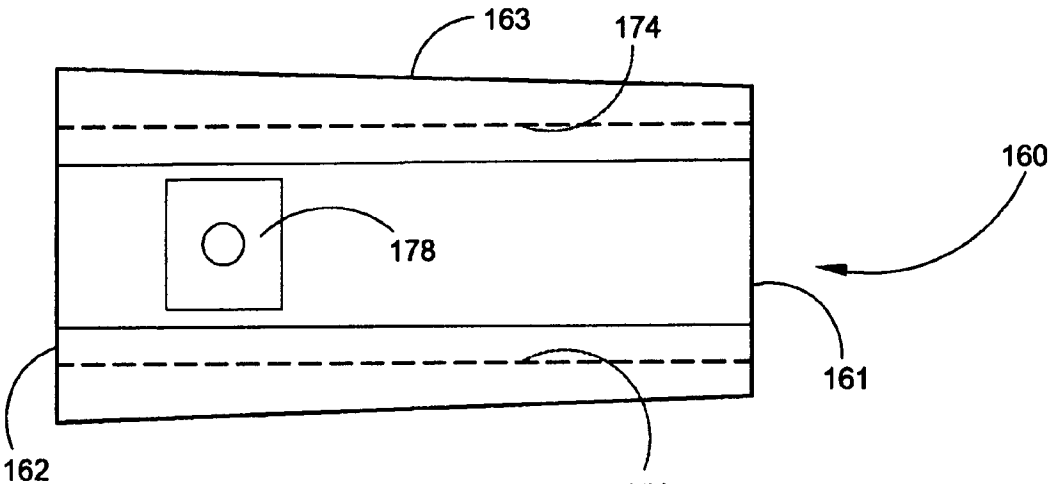
FIG. 22 is a top plan view of the cover member.
Figure 24:
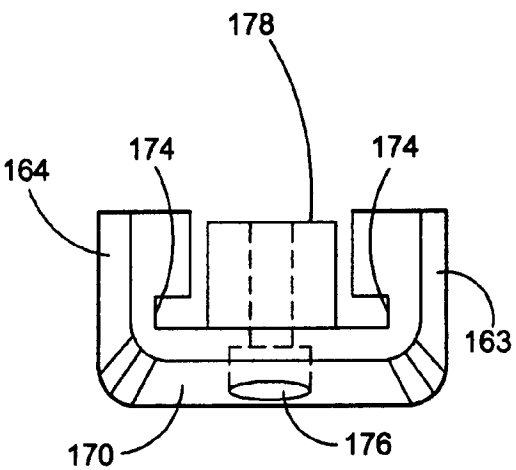
FIG. 24 is a front elevation view of the cover member.
Figure 23:
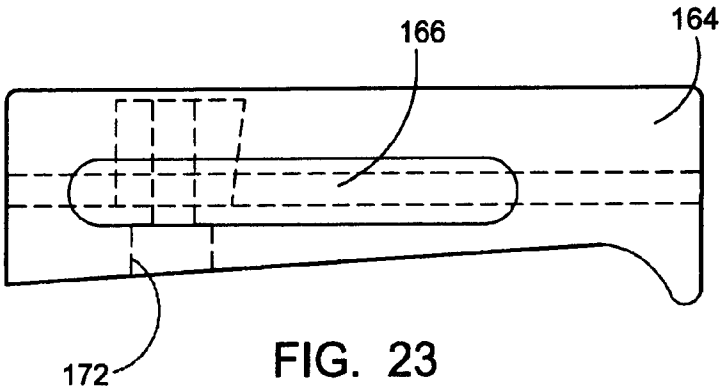
FIG. 23 is a side elevation of the cover member.

FIG. 27 is a side elevation view illustrating a flashlight and a laser light mounted on the front end of a handgrip member.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and the number and configuration of various vehicle components described above may be altered, all without departing from the spirit or scope of the invention as defined in the appended Claims.

What is claimed:

1. A firearm comprising:

A receiver having a front end and a rear end;

an elongated gun barrel having a front end and a rear end; said rear end of said gun barrel being connected to said front end of said receiver;

an elongated magazine for shells; said magazine having a front end and a rear end; said rear end of said magazine being connected to said front end of said receiver;

an elongated forend having a front end, a rear end, a left side wall, a right side wall and a bottom wall; and recoil reduction means attached to said forend, wherein said recoil reduction means further comprises a longitudinally extending rail extending downwardly from said bottom surface of said forend; an upright oriented handgrip having a top end, a bottom end, a front end, and a primary chamber that extends upwardly within said handgrip, and further wherein a track is formed in said top end of said handgrip, said rail being slidably received in said track to support said handgrip; and said recoil reduction means is mounted in said primary chamber of said handgrip.

2. A firearm as recited in claim 1 wherein said recoil reduction means further comprises a spring, and said spring is mounted in said primary chamber of said handgrip and said handgrip is attached to said forend.

3. A firearm as recited in claim 2 wherein said magazine is tubular and said magazine passes longitudinally through said forend.

4. A firearm as recited in claim 3 wherein said forend has a U-shaped transverse cross section.

5. A firearm as recited in claim 4 wherein further comprising an elongated mounting unit having a longitudinally extending bore hole that allows said mounting unit to be telescopically mounted on said elongated magazine.

6. A firearm as recited in claim 5 wherein said elongated mounting unit is telescopically received in said forend.

7. A firearm as recited in claim 1 wherein said firearm is a shotgun.

8. A firearm as recited in claim 1 further comprising a longitudinally extending rail extending downwardly from said bottom surface of said forend; an upright oriented handgrip having a top end, a bottom end, a front end, and a primary chamber that extends upwardly within said handgrip; a track is formed in said top end of said handgrip;

said rail being slidably received in said track to support said handgrip; and said recoil reduction means is mounted in said primary chamber of said handgrip;

and further wherein said recoil reduction means includes a spring whereby said spring is mounted within said primary chamber of said handgrip.

9. A firearm as recited in claim 1, wherein said recoil reduction means includes a spring mounted within said primary chamber of said handgrip.

10. A firearm as recited in claim 9, wherein said spring includes a coil spring.

11. A firearm as recited in claim 10, wherein said spring includes a coil spring surrounding a threaded rod and whereby said coil spring is held in place surrounding said threaded rod by a nut, whereby the tension in said coil spring can be adjusted by threading said nut upwardly or downwardly along said threaded rod.

12. A firearm as recited in claim 9, wherein said spring includes a cam roller, a lever and a leaf spring.

13. A firearm as recited in claim 9, wherein said spring includes an elastomer block.

14. A firearm as recited in claim 1, wherein said firearm is a rifle.

* * * * *